United States Patent [19]

Mason et al.

[11] 4,158,348

[45] Jun. 19, 1979

[54] SYSTEM FOR RETARDING ENGINE SPEED

[76] Inventors: Lloyd R. Mason, P.O. Box 224, Boonville, Calif. 95414; Oscar C. Smith, 450 Crestview Dr., Ukiah, Calif. 95482

[21] Appl. No.: 811,636

[22] Filed: Jun. 30, 1977

[51] Int. Cl.[2] ..... F02D 13/04

[52] U.S. Cl. ..... 123/97 B; 123/105; 123/90.12

[58] Field of Search ..... 123/104, 105, 107, 97 B, 123/75 E, 90.12, 90.13

[56] References Cited

U.S. PATENT DOCUMENTS

| | | | |
|---|---|---|---|
| 3,220,392 | 11/1965 | Cummins | 123/90.12 |
| 3,367,312 | 2/1968 | Jonsson | 123/97 B |
| 3,439,662 | 4/1969 | Jones | 123/90.12 |
| 3,547,087 | 12/1970 | Siegler | 123/97 B |
| 3,986,351 | 10/1976 | Woods et al. | 123/105 |
| 4,033,304 | 7/1977 | Luria | 123/105 |

FOREIGN PATENT DOCUMENTS

| | | | |
|---|---|---|---|
| 4639894 | 7/1968 | Japan | 123/97 B |

*Primary Examiner*—Charles J. Myhre
*Assistant Examiner*—Jeffrey L. Yates
*Attorney, Agent, or Firm*—Melvin R. Stidham

[57] ABSTRACT

An engine retarder for a fuel injection engine wherein a charge of fuel is pumped to each cylinder under pressure in timed sequence to reach the cylinder near top dead center of its stroke. A selectively operated bypass valve enables that measured charge of fuel to be delivered at the same time in the cycle, not into the cylinder, but to an actuator which opens the cylinder's exhaust valve near the completion of the piston's compression stroke and then allows the valve to close, the charge of fuel being returned to the tank.

6 Claims, 3 Drawing Figures

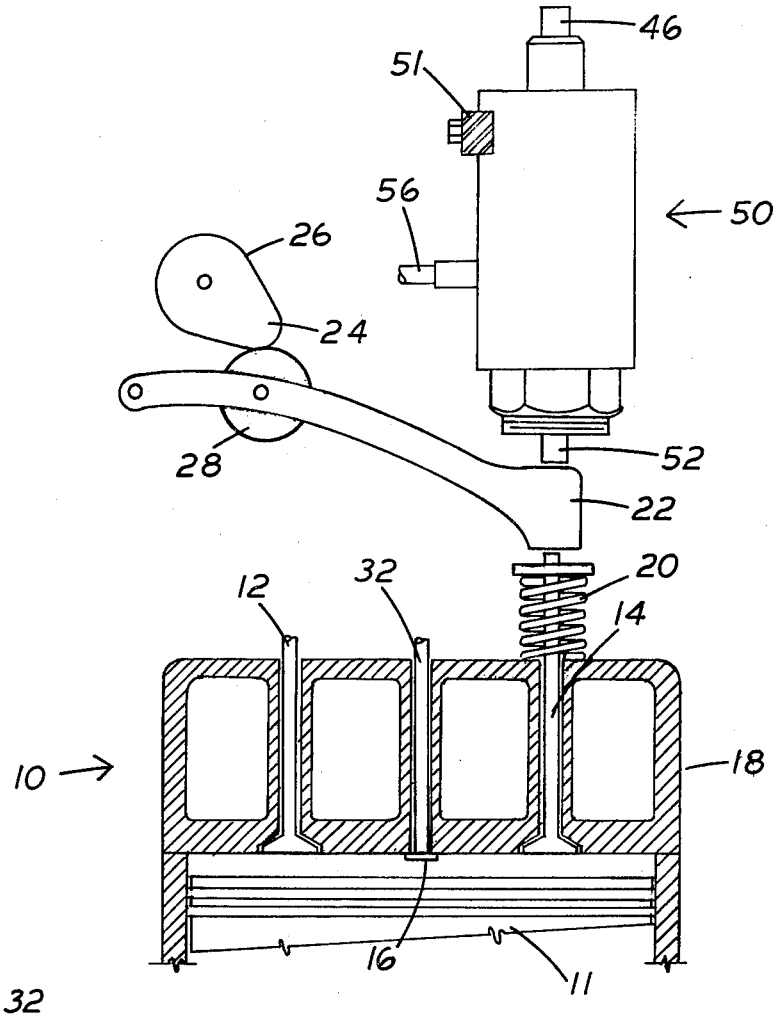
FIG. 1
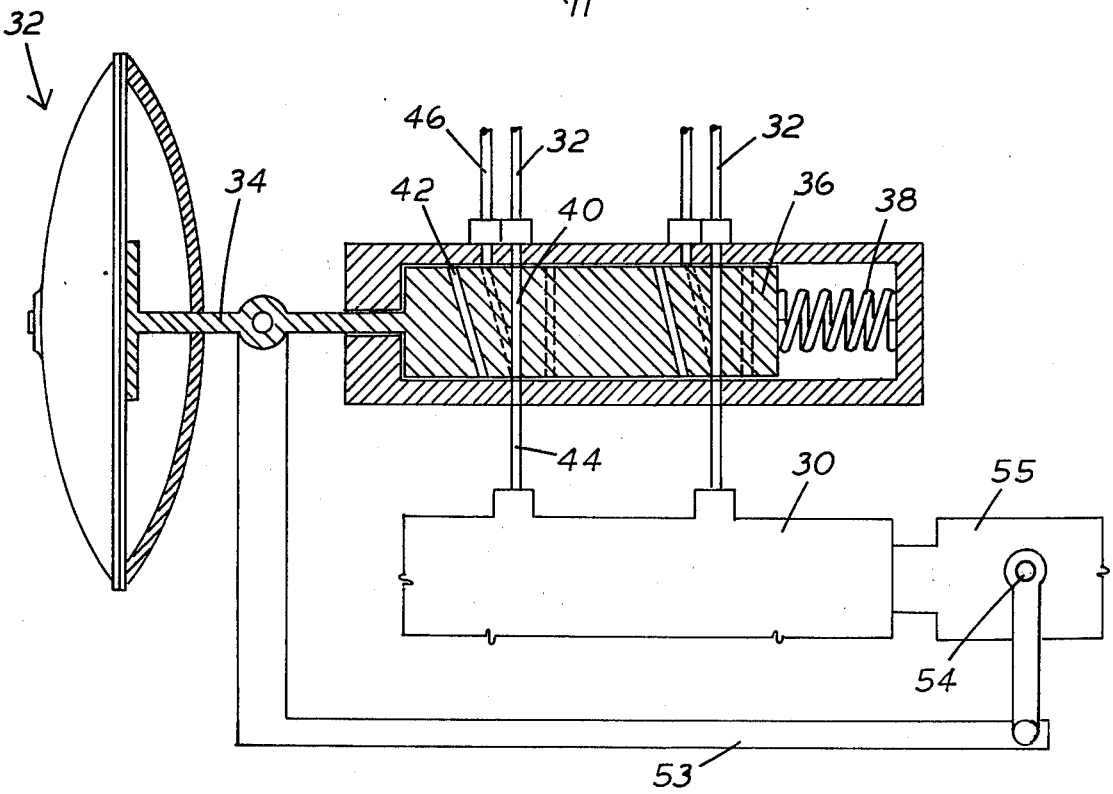

SYSTEM FOR RETARDING ENGINE SPEED

BACKGROUND OF THE INVENTION

In motor vehicles, particularly heavy trucks, there is a need for means to retard the vehicle speed, particularly on downgrades, without requiring constant brake pressure which might cause brake damage through friction. Others have sought to alleviate this problem by governing engine speed by utilizing cams to open the engine exhaust valves on the compression and power strokes. However, such systems did not alter the fuel injection cycles, and fuel continues to be delivered to the cylinder at the regular time in its cycle, whereby it simply is exhausted to the atmosphere and wasted. Moreover, with the exhaust valve open during the downstroke there is little resistance to piston downstroke and little or not retardation experienced during such stroke.

OBJECTS OF THE INVENTION

It is an object of this invention to provide an engine retarding system which produces effective engine retardation or drag during more than one stroke of the piston.

It is a further object of this invention to provide an actuator which opens the exhaust valve near completion of the compression stroke, and quickly closes it for retardation during the normal power stroke of the piston.

It is a further object of this invention to provide an engine retarding system which conserves, rather than wastes, fuel during operation.

Other objects and advantages of this invention will become apparent from the description to follow, particularly when read in conjunction with the accompanying drawings.

SUMMARY OF THE INVENTION

In carrying out this invention, we provide a system for installation in a fuel injection internal combustion engine, wherein a pump delivers a measured charge of fuel under pressure to each cylinder in timed sequence to be injected at or near the top dead center of the piston travel on the compression stroke. A bypass valve in the system is selectively operated so that fuel from the pump is diverted from the injection nozzle and directed to an exhaust valve actuator, whereby at the time it would normally be jetted into the piston, i.e. near top dead center of piston travel, it arrives at the actuator to open the exhaust valve. Hence, no fuel is mixed with the air compressed in the cylinder, and air alone is exhausted to the atmosphere. The actuator includes a piston which is driven by the charge of fuel and carries a plunger to open the exhaust valve. At the end of its stroke, the actuator piston uncovers a bleed passageway to relieve pressure and return the fuel to the tank. With pressure so relieved a plunger valve in the piston head opens under spring force, whereby bleeding of the fuel continues through the piston when the bleed passageway is again covered on the return stroke. Hence the actuator piston is quickly retracted and all of the fuel used to operate it is conserved and returned to the tank. With the engine cylinder exhaust valve again closed, the piston leaves a vacuum behind it as it moves through normal power stroke further to retard its movement.

BRIEF DESCRIPTION OF THE DRAWINGS

In the drawings:

FIG. 1 is a schmatic illustration of the fuel retarding system of this invention.

DESCRIPTION OF A PREFERRED EMBODIMENT

Figure 2:
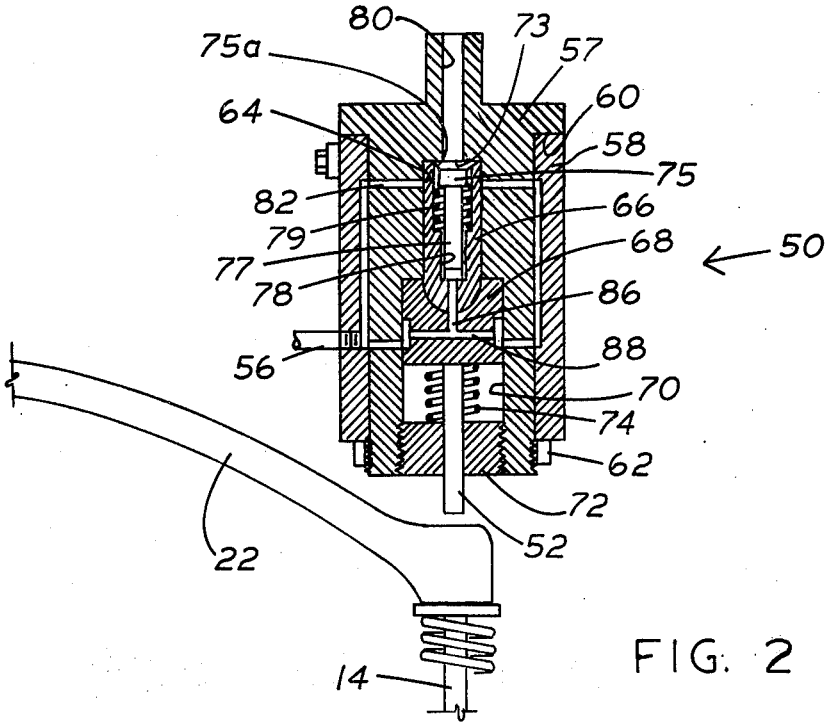
FIGS. 2 and 3 are section views of the exhaust valve actuator comprising a feature of this invention.

Referring now to FIG. 1 with greater particularity, there is shown the cylinder head 10 with piston 11 of a fuel injection internal combustion engine, the cylinder including air intake valve 12, exhaust valve 14 and fuel jet 16 carried in the cylinder head 18 in conventional fashion. Referring particularly to the exhaust valve 14, it is of the poppet type biased into closed position by spring means 20 and urged into open position by engagement of a rocker arm 22 in timed sequence in the engine cycle of operation, in response to movement of a lobe 24 on cam 26 over a cam follower 28 carried on the rocker arm 22.

In the normal operation, a charge of fuel is fed from a fuel injection pump 30 and directed through fuel lines 32 to be introduced into each cylinder 10 just prior to the completion of its compression stroke, represented by the top dead center position of the piston 11 and then, after the piston is driven down to complete its power stroke, the cam lobe 24 engages the follower 28 to open the exhaust valve 14 during the return or exhaust stroke in order to evacuate the cylinder 10.

In accordance with this invention, when it is desired to utilize the engine 10 as a brake to retard vehicle movement, the operator actuates a suitable means, such as a charge of available compressed air to a diaphragm actuator 32 which forces a rod 34 to the right in FIG. 1 carrying a spool 36 against a spring 38. The spool has a plurality of pairs of flow passageways 40 and 42 therethrough which, depending upon the position of the spool 36, direct the fuel from the outlet lines 44 of the injection fuel pump 30 to one of two flow lines 32 and 46. In the normal position shown in solid lines in FIG. 1, the flow is from fuel pump 30 and outlet line 44 to fuel line 32, charging the fuel injector 16. However, when the spool is forced to the right in FIG. 1, the passageways 42 are aligned with the pump outlet lines 44, whereby each charge of fuel under pressure is driven from the fuel pump 30 to a line 46 to operate for the cylinder normally supplied, the exhaust valve actuator 50 of this invention.

An actuator 50 may be mounted by suitable means 51 above the rocker arm 22 of each cylinder, whereby a plunger 52 depresses the rocker arm 22 and opens the exhaust valve 14 during that period of time, i.e. during the completion of the compression stroke, when the fuel is normally being fed to the cylinder 10. Also movable with the control valve spool 36 is an arm 53 which activates an override shaft 54 on a fuel ratio control 55 so that the pump 30 will deliver in each charge enough fuel to operate the exhaust valve actuator 50 in a manner to be described.

As a result of the fuel being diverted from the injection nozzle 16 and directed to the exhaust valve actuator 50, there is, of course, no combustion and hence, no power stroke in the usual sense. The overall effect is to retard engine operation by cycling it through its usual compression stroke with no combustion and then, during the normal power stroke, when the exhaust valve 14 is again closed and the piston retracts, a vacuum is created above it and the resultant pressure differential across the piston further retards engine operation. In the meantime, the fuel is not wasted but is redirected through line 56 to the fuel tank in a manner hereinafter to be described.

Figure 3:
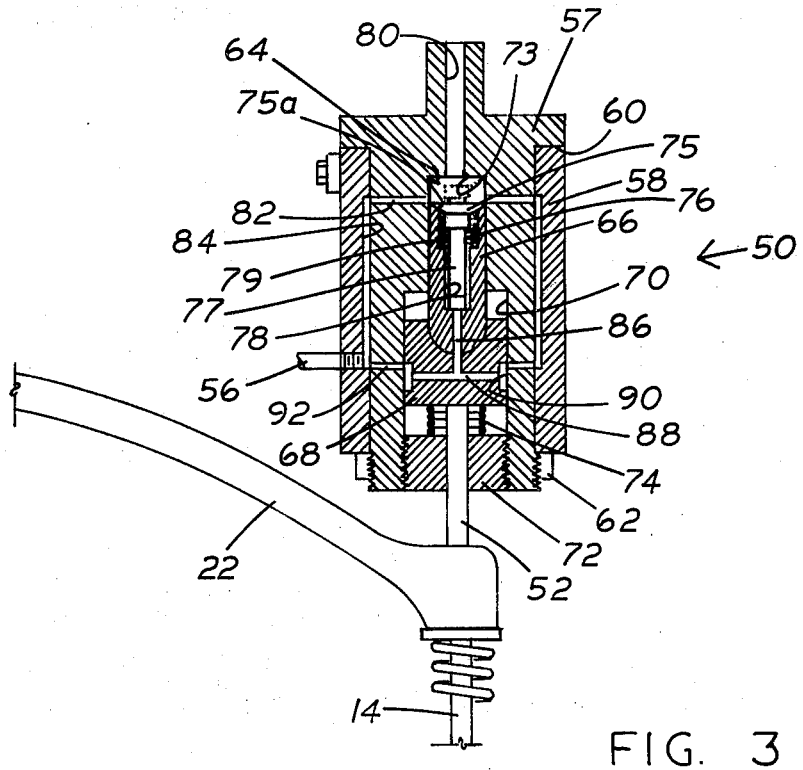

Referring now to FIGS. 2 and 3, the exhaust valve actuator 50 of this invention includes a valve body comprising, essentially, two pieces, a cylindrical core 57 and a tubular housing 58, the housing being secured on the core 56 as by clamping it between a radial shoulder 60 the core and a nut 62 threaded onto the other end thereof.

A longitudinal bore 64 in the core 56 slidably receives a piston 66 and a plunger head 68 is slidably received in a counterbore 70 in the end of which a bushing 72 is threaded to accommodate the plunger 52, for sliding movement therein. The piston 66 is urged upwardly against the end 73 of the bore 64, as shown, by means of a suitable coil spring 74 bearing between the bushing 72 and the plunger head 68.

A poppet valve 75 is received in an axial bore 76 in the head of actuator piston 66, with a stem 77 loosely received in a small bore 78 in communication therewith. The valve 77 is biased outward by a spring 79 but is held against its seat 75a by the force of the larger spring 74 biasing the piston against the wall 73, normally to close off the intake port 80, as shown in FIG. 2. Lateral relief ports 82 open from the bore 64 to communicate with longitudinal relief transfer passages 84 formed in the casing 58.

Exhaust passages 86 and 88 through the trailing end of the piston and laterally through the plunger head 68 open to an annular clearance 90 therearound, which maintains communication with lateral bleed outlets 92 throughout its stroke. The exhaust passages 86 and 88 enable evacuation of the passageway 44 past the valve 76 and stem 88 while the valve 76 is lifted from its seat 67a, as shown in phantom in FIG. 3. All fuel bled through ports 82 opening into the main passageway 64 and port 86 from the piston bore 76 are directed to outlet duct 56 back to the fuel tank (not shown). Hence, the fuel utilized to operate the valve actuator 50 is made available for further operation and/or for combustion, and there is no waste.

When the operator wishes to use the engine as a brake, as when on a highway downgrade, he actuates the pneumatic operator 32 (FIG. 1) to shift the valve spool 36 to the right against the force of the spring 38. This diverts each timed charge of fuel from the appropriate outlet 44 of the injection pump 30 away from the corresponding fuel line 32 to each cylinder and through the pressure line 46 to operate the exhaust valve actuator 50 for that cylinder.

The charge of fuel under pressure so diverted enters the port 80 of the actuator 50 and drives the piston 66, with its contained poppet valve 75, downward from the normal position shown in FIG. 2 to that shown in FIG. 3, whereby the cam follower 22 is depressed to open the exhaust valve 14, overriding the cam 24.

When the lateral bleed ports 82 opening from the main passageway 64 are uncovered, the pressure fluid starts to relieve therethrough, and thence to passageways 84 and return line 54. As pressure is so relieved, the plunger head 68 and piston 66 commence returning under force of spring 74, but in advance thereof, the spring 79 in the piston bore 76 unseats the poppet valve 75 so that relieving continues through the internal piston bleed paths 86 and 88 and out through return line, and this continues despite blocking of lateral bleed lines 82 during return of the piston 66.

As a result of the complete bleeding of the piston passageway 64 just described the exhaust valve 14 is quickly released to enable it to close. Hence, the exhaust valve is closed through virtually all of the compression stroke before operation of the actuator 50 and through most of the normal power stroke after operation thereof. The result is engine retardation during both strokes. First, during compression and then return without help of ignition with a vacuum created behind it. This is repeated for each cylinder 10 in regular firing order as long as the valve spool 36 remains shifted to the right. When the diaphragm actuator 32 is relieved, as at the bottom of a downgrade, the spring 88 returns the spool to the position shown in solid lines in FIG. 1 for normal ignition sequences.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. For use in an internal combustion engine including:
- a cylinder;
- a piston reciprocable in said cylinder;
- a fuel nozzle opening into said cylinder;
- an exhaust valve in said cylinder;
- a pump for delivering a quantity of fluid from an outlet timed to jet from said nozzle when said piston is near the end of its compression stroke; and
- cam means for opening said exhaust valve after said piston has completed its power stroke;
- an engine retarding system comprising:
- a pressure fluid-operated actuator for opening said exhaust valve;
- a pressure line for delivering fluid to said actuator;
- a bypass valve connected to the outlet of said pump and operative in a first position to deliver fluid to said fuel nozzle and in a second position to deliver fluid to said pressure line; and
- means operative to move said bypass valve selectively to one of said first and second positions.

2. The engine retarding system defined by claim 1 wherein said actuator includes;
- means for relieving pressure fluid therefrom after said exhaust valve is opened.

3. The engine retarding means defined by claim 1 wherein said exhaust valve actuator comprises:
- a housing having a cylindrical passageway therein;
- a piston slidable in said passageway;
- means biasing said piston toward a retracted position;
- said piston being extended by fluid from said pump in said pressure line; and
- a plunger on said piston operative when extended to open said exhaust valve.

4. The engine retarding means defined by claim 3 including:
- a bleed passageway in said housing opening into said cylindrical passageway and situated so as to be blocked by said piston when retracted and uncovered thereby when extended.

5. The engine retarding means defined by claim 4 including:
- a fluid return line connected to said bleed passageway to return fluid to a sump;

6. The engine retarding means defined by claim 3 including:

a pressure port opening into said cylindrical passageway at the end thereof;

an exhaust passageway through said piston opening through a valve seat at the head thereof;

a valve adapted to be received in said passageway to engage said seat; and spring means biasing said valve outward of said engine head, away from said seat;

said spring being adapted to overcome pressure fluid in said cylindrical passageway after same is partially relieved through said bleed passageway.

* * * * *